US010989510B2

(12) United States Patent
Mohler et al.

(10) Patent No.: US 10,989,510 B2
(45) Date of Patent: Apr. 27, 2021

(54) PRIMER HOUSING FOR FIREARMS AND OTHER MUNITIONS

(71) Applicant: Spectre Enterprises, Inc., Melbourne, FL (US)

(72) Inventors: Timothy Mohler, Melbourne, FL (US); Daniel Yates, Melbourne, FL (US)

(73) Assignee: SPECTRE ENTERPRISES, INC., Melbourne, FL (US)

( * ) Notice: Subject to any disclaimer, the term of this patent is extended or adjusted under 35 U.S.C. 154(b) by 0 days.

(21) Appl. No.: 15/931,340

(22) Filed: May 13, 2020

(65) Prior Publication Data

US 2020/0400415 A1 Dec. 24, 2020

Related U.S. Application Data

(60) Provisional application No. 62/847,285, filed on May 13, 2019.

(51) Int. Cl.
*F42C 19/08* (2006.01)

(52) U.S. Cl.
CPC ..... *F42C 19/083* (2013.01); *F42C 19/0807* (2013.01)

(58) Field of Classification Search
CPC ..... F42C 19/083; F42C 19/0807; F42C 19/10
See application file for complete search history.

(56) References Cited

U.S. PATENT DOCUMENTS 2,926,607 A * 3/1960 Muller, Jr. ..... F42C 19/10 102/530
3,446,146 A * 5/1969 Gawlick ..... F42C 19/083 102/470
4,014,264 A * 3/1977 Bendler ..... F42B 3/125 102/202.6
4,850,274 A * 7/1989 Brede ..... F42C 19/0807 102/202
5,113,764 A 5/1992 Mandigo et al.
5,969,288 A 10/1999 Baud
6,286,432 B1 * 9/2001 Reider ..... F42C 19/0807 102/202
8,298,358 B1 10/2012 Coffey et al.
8,465,608 B1 6/2013 Coffey et al.
(Continued)

FOREIGN PATENT DOCUMENTS

DE 1205424 B * 11/1965 ..... F42C 19/10
DE 3804847 A1 * 8/1989 ..... C06C 5/06
(Continued)

*Primary Examiner* — Joshua T Semick
(74) *Attorney, Agent, or Firm* — William F. Lang IV; Lang Patent Law LLC

(57) ABSTRACT

A primer structure is provided for holding a deposited ignitable material, and for holding the ignitable material within a firearm cartridge or within another munition. The primer includes a disk and a retaining ring. Ignitable material is deposited on a surface of the disk. The retaining ring is positioned in front of the disk. The retaining ring includes angled passageways for reaction products to travel from the ignitable material to the propellant. The forwardmost surface of the retaining ring, as well as the angle of the passageways, dissipate pressure that would otherwise be borne by the disk. Both the disk and retaining ring include angled or stepped surfaces to resist movement under pressure.

3 Claims, 8 Drawing Sheets

(56) References Cited

U.S. PATENT DOCUMENTS

| | | | | |
|---|---|---|---|---|
| 9,618,307 | B1 | 4/2017 | Redington et al. | |
| 9,784,548 | B2 * | 10/2017 | Soohoo | E21B 43/11 |
| 2016/0102030 | A1 | 4/2016 | Coffey et al. | |
| 2016/0161237 | A1 | 6/2016 | Winter et al. | |
| 2019/0128656 | A1 * | 5/2019 | Mohler | F42C 19/083 |

FOREIGN PATENT DOCUMENTS

| | | | | | |
|---|---|---|---|---|---|
| FR | 412915 | A | * | 7/1910 | F42C 19/10 |
| FR | 1069134 | A | * | 7/1954 | F42C 19/0838 |
| FR | 1409996 | A | * | 9/1965 | F42B 3/11 |
| GB | 191004449 | A | * | 7/1910 | F42C 19/10 |
| GB | 1034393 | A | * | 6/1966 | F42C 19/10 |

* cited by examiner

PRIMER HOUSING FOR FIREARMS AND OTHER MUNITIONS

CROSS REFERENCE TO RELATED APPLICATION

This application claims the benefit of U.S. provisional patent application Ser. No. 62/847,285, which was filed on May 13, 2019, and entitled "Primer for Firearms and Other Munitions."

TECHNICAL FIELD

The present invention relates to primers and housings for primers for firearms and other munitions. More specifically, a primer structure is provided for holding a deposited ignitable material, and for holding the ignitable material within a firearm cartridge or within another munition.

BACKGROUND INFORMATION

Cartridges for firearms, as well as other munitions such as larger projectile cartridges and explosives are often ignited by a primer. Presently available primers and detonators are made from a copper or brass alloy cup with a brass anvil and containing lead azide or lead styphnate. When the base of the cup is struck by a firing pin, the priming compound is crushed between the cup's base and the anvil, igniting the primer charge. The burning primer then ignites another flammable substance such as smokeless powder, explosive substances, etc. Lead azide and lead styphnate are hazardous due to their toxicity as well as their highly explosive nature. Additionally, present manufacturing methods are very labor-intensive, with the necessary manual processes raising costs, causing greater difficulty in maintaining quality control.

Energetic materials such as thermite are presently used when highly exothermic reactions are needed. Uses include cutting, welding, purification of metal ores, and enhancing the effects of high explosives. A thermite reaction occurs between a metal oxide and a reducing metal. Examples of metal oxides include $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, CoO, $Co_3O_4$, $Sb_2O_3$, PbO, $Fe_2O_3$, $Bi_2O_3$, $MnO_2$, $Cu_2O$, and CuO. Example reducing metals include Al, Zr, Th, Ca, Mg, U, B, Ce, Be, Ti, Ta, Hf, and La. The reducing metal may also be in the form of an alloy or intermetallic compound of the above-listed metals.

A properly designed energetic material, for example, that which is disclosed in US 2016/0102030, which was invented by K. R. Coffey et al. and published on Apr. 14, 2016, would provide an effective alternative to presently used primer materials, as well as being safer to manufacture. The entire disclosure of US 2016/0102030 is expressly incorporated herein by reference. A primer relying on such an ignitable material may require different physical structures and different manufacturing methods than a conventional primer.

Advanced primer and propellant designs can potentially increase the pressure generated within munitions so that it exceeds that for which conventional primer installations are designed. Accordingly, there is a need for a primer cup for easily installing such a primer within a cartridge casing, or within another location that is designed to receive a conventional primer. There is a further need for a primer structure that can safely withstand pressure levels greater than those that can be safely withstood by conventional primers and conventional primer installations.

SUMMARY

The above needs are met by a housing for a primer, comprising a disk having a first face, a second face, and an edge defined between the first face and second face. The second face has a larger cross sectional area than the first face. The edge has a pressure-resisting configuration. The primer housing further comprises a retention piece having an open end, a closed end, and a side wall extending therebetween. The open end is dimensioned and configured to substantially match the second face of the disk. The closed end has a larger cross sectional area than the open end. A portion of the side wall has a pressure-resisting configuration. The retention piece defines a recess within the open end. The retention piece further defines a central axis extending between the open end and the closed end. The retention piece defines a plurality of channels extending from the recess to the closed end, with the channels being angled from parallel to the central axis.

The above needs are further met by a primer, comprising a disk having a first face, a second face, and an edge defined between the first face and second face. The second face has a larger cross sectional area than the first face. The edge has a pressure-resisting configuration. The second face of the disk has an ignitable material thereon. The primer further comprises a retention piece having an open end, a closed end, and a side wall extending therebetween. The open end is dimensioned and configured to substantially match the second face of the disk. The closed end has a larger cross sectional area than the open end. A portion of the side wall has a pressure-resisting configuration. The retention piece defines a recess within the open end. The retention piece further defines a central axis extending between the open end and the closed end. The retention piece defines a plurality of channels extending from the recess to the closed end, with the channels being angled from parallel to the central axis.

The above needs are additionally met by a firearm cartridge, comprising a casing having a sidewall, a front end, and a back end. The back end defini a primer pocket therein, with the primer pocket having a side surface. The cartridge further has a primer. The primer comprises a disk having a first face, a second face, and an edge defined between the first face and second face. The second face has a larger cross sectional area than the first face. The edge has a pressure-resisting configuration. The second face of the disk has an ignitable material thereon. The cartridge additionally has a retention piece having an open end, a closed end, and a side wall extending therebetween. The open end is dimensioned and configured to substantially match the second face of the disk. The closed end has a larger cross sectional area than the open end. A portion of the side wall has a pressure-resisting configuration. The retention piece defines a recess within the open end. The retention piece further defines a central axis extending between the open end and the closed end. The retention piece defines a plurality of channels extending from the recess to the closed end, with the channels being angled from parallel to the central axis. The side surface of the primer pocket has a shape that substantially matches the pressure-resisting configuration of the disk and the pressure-resisting configuration of the retention piece, whereby movement of the retention ring and disk caused by pressure inside the casing is resisted by interaction of the side surface of the primer pocket with the pressure-resisting surfaces of the disk and retention piece.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
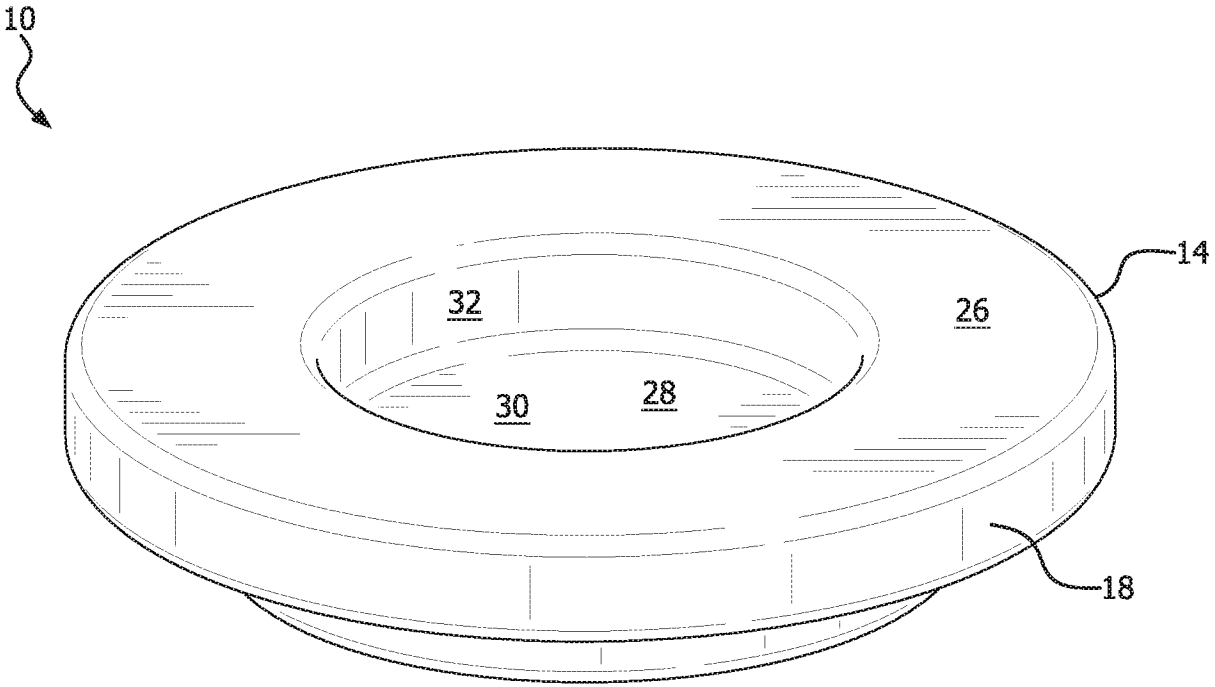
FIG. 1 is a perspective view of a primer disk.

Referring to the drawings, there is shown a primer assembly for which deposited ignitable material, for example, thermite, can be used in place of presently used priming compounds. The primer assembly includes a disk 10 and a retaining ring or retention piece 12. As used herein, terms such as upper, lower, top, bottom, front, back, etc. are used for convenience of reference, recognizing that rotating a components will change the top, bottom, etc. Thus, these terms are not intended to be limiting except to the extent that they describe relationships with each other when the components are oriented as illustrated.

Figure 2:
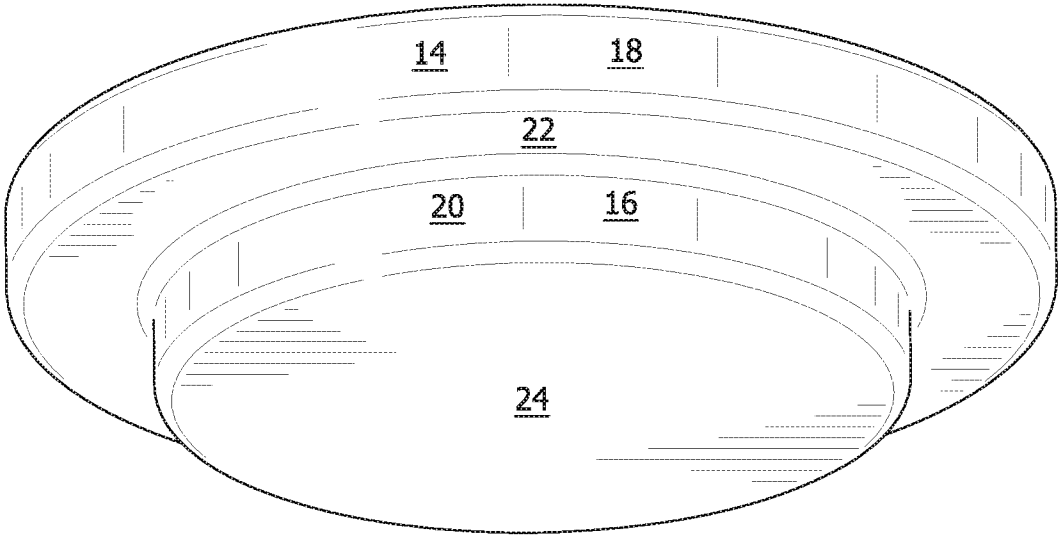
FIG. 2 is another perspective view of the primer disk of FIG. 1.
Figure 3:
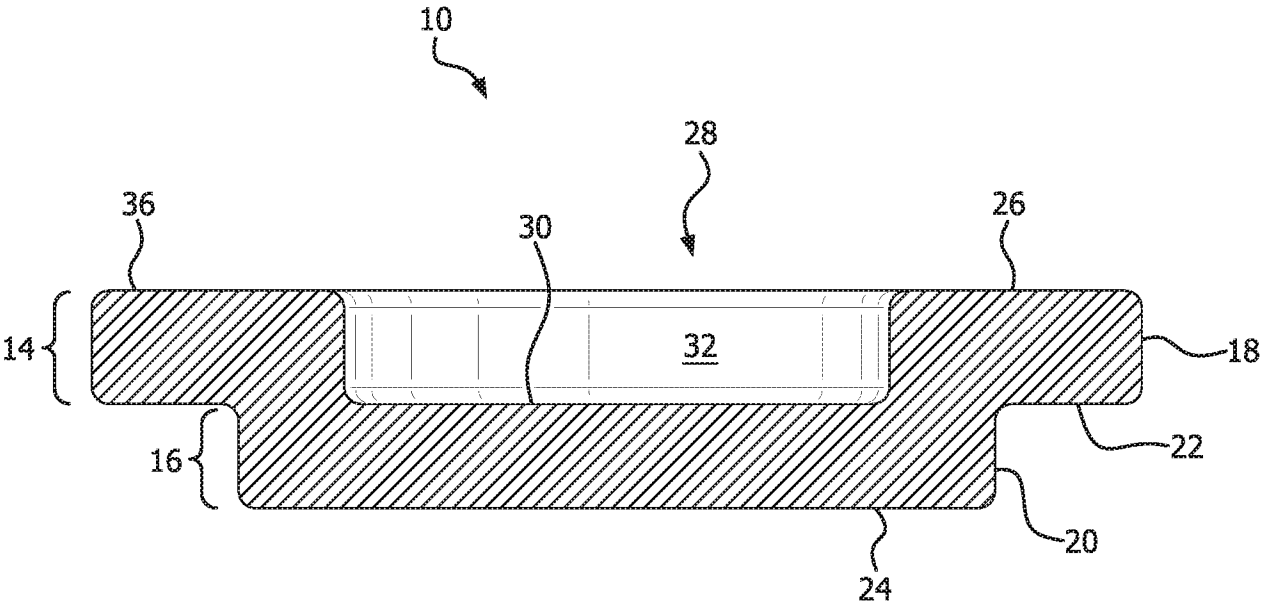
FIG. 3 is a cross sectional view of the primer disk of FIG. 1.

Referring to FIGS. 1-3, a disk 10 is illustrated. The disk 10 includes an upper portion 14 and a lower portion 16. The illustrated example of the disk 10 is round, with the upper portion 14 having a larger diameter than the lower portion 16. The disk 10 includes an edge having a pressure-resisting configuration. As used herein, a pressure-resisting configuration is defined as an angled surface and/or a stepped surface which, when placed in contact with a similarly-shaped surface of another object, resists movement of the pressure-resisting configuration with respect to the other object in at least one direction. In the illustrated example, the upper portion 14 includes a sidewall 18, and the lower portion 16 includes a sidewall 20. A surface 22 is defined between the sidewall 18 and sidewall 20. The lower portion 20 includes a lower surface 24, which is also called a first surface herein. As an alternative to this stepped surface, an angled surface may extend between a position within the upper portion 14 and a position within the lower portion 16, for example, from the upper surface 26 to the lower surface 24. The upper portion 14 includes an upper surface 26 defining a recess 28 (with the total area of the upper surface 26 and recess 28 also being called a second surface herein) having a bottom surface 30 and a sidewall 32. In the illustrated example, the cavity 28 is centrally located within the disk 10. Depending upon the pressure to which the disk 10 will be subjected, the disk 10 may be made from materials that are typically used for firearm cartridge components such as copper or brass, or from a steel such as stainless steel.

Figure 8:
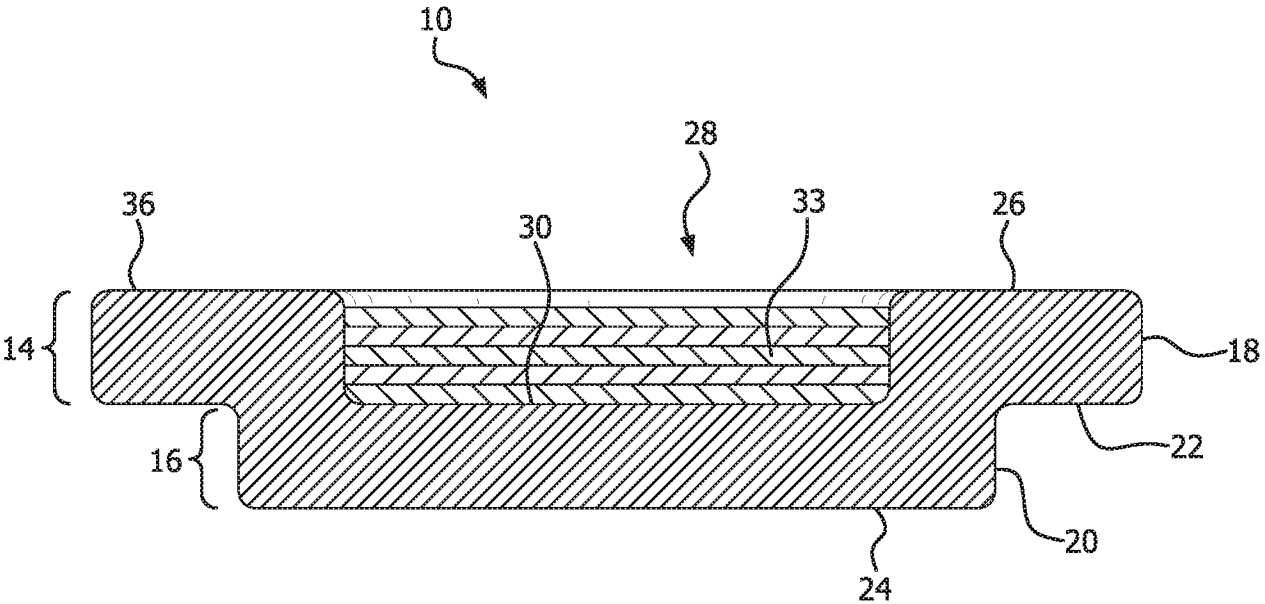
FIG. 8 is a cross sectional view of the primer disk of FIG. 1.

As shown in FIG. 8, the recess 22 contains a deposited ignitable material 33, for example, thermite. Examples of deposited ignitable materials or methods of making a deposited ignitable material are disclosed within each of the following patent applications, the entire disclosure of each of which is expressly incorporated herein by reference: US 2016/0102030, which was invented by Kevin R. Coffey et al. and published on Apr. 14, 2016; and US 2019/0128656, which was invented by Timothy Mohler et al. and published on May 2, 2019. Additionally, methods of depositing such ignitable material are disclosed within U.S. Pat. No. 8,298,358, issued to Kevin R. Coffey et al. on Oct. 30, 2012; U.S. Pat. No. 8,465,608, and issued to Kevin R. Coffey et al. on Jun. 18, 2013, the entire disclosures of which are expressly incorporated herein by reference.

Additionally, one or more layers of zirconium or zirconium carbide may be included within the layers of reducing metal and metal oxide. The zirconium or zirconium carbide layer or layers enhance the ability of the primer to project the ignition products into the propellant within the body of the cartridge case, enhancing the reliability with which that propellant can be ignited.

Figure 4:
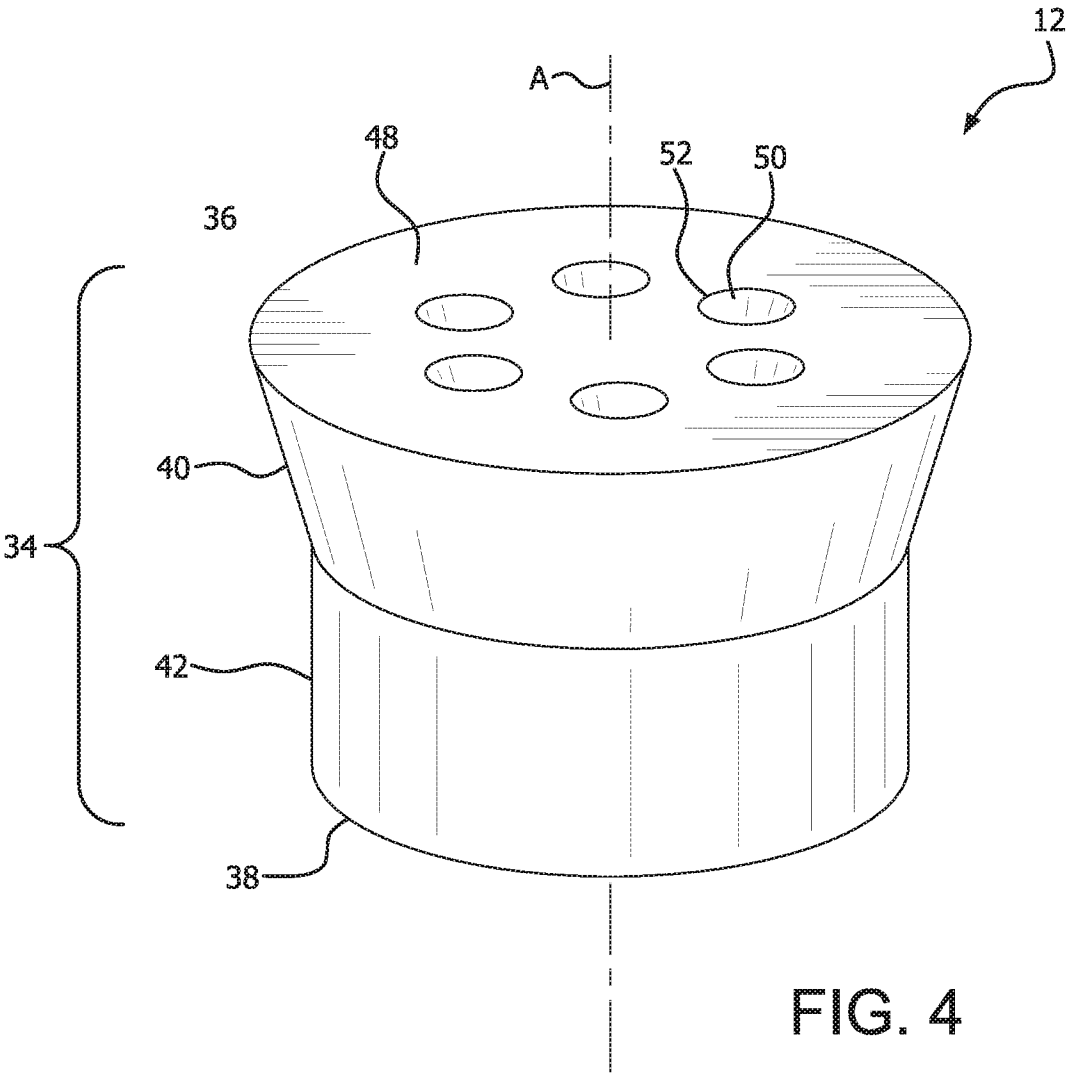
FIG. 4 is a perspective view of a retaining ring for a primer disk of FIG. 1.
Figure 5:
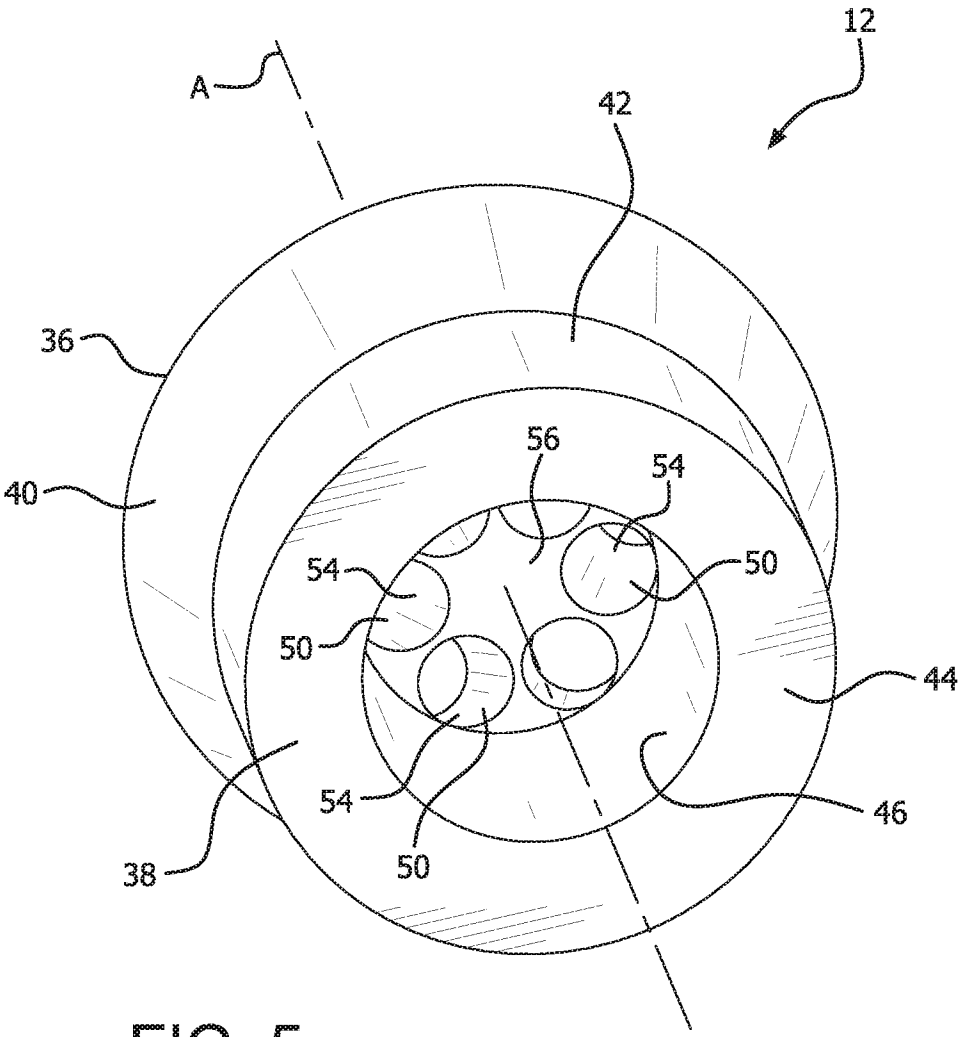
FIG. 5 is another perspective view of the retaining ring of FIG. 4.
Figure 6:
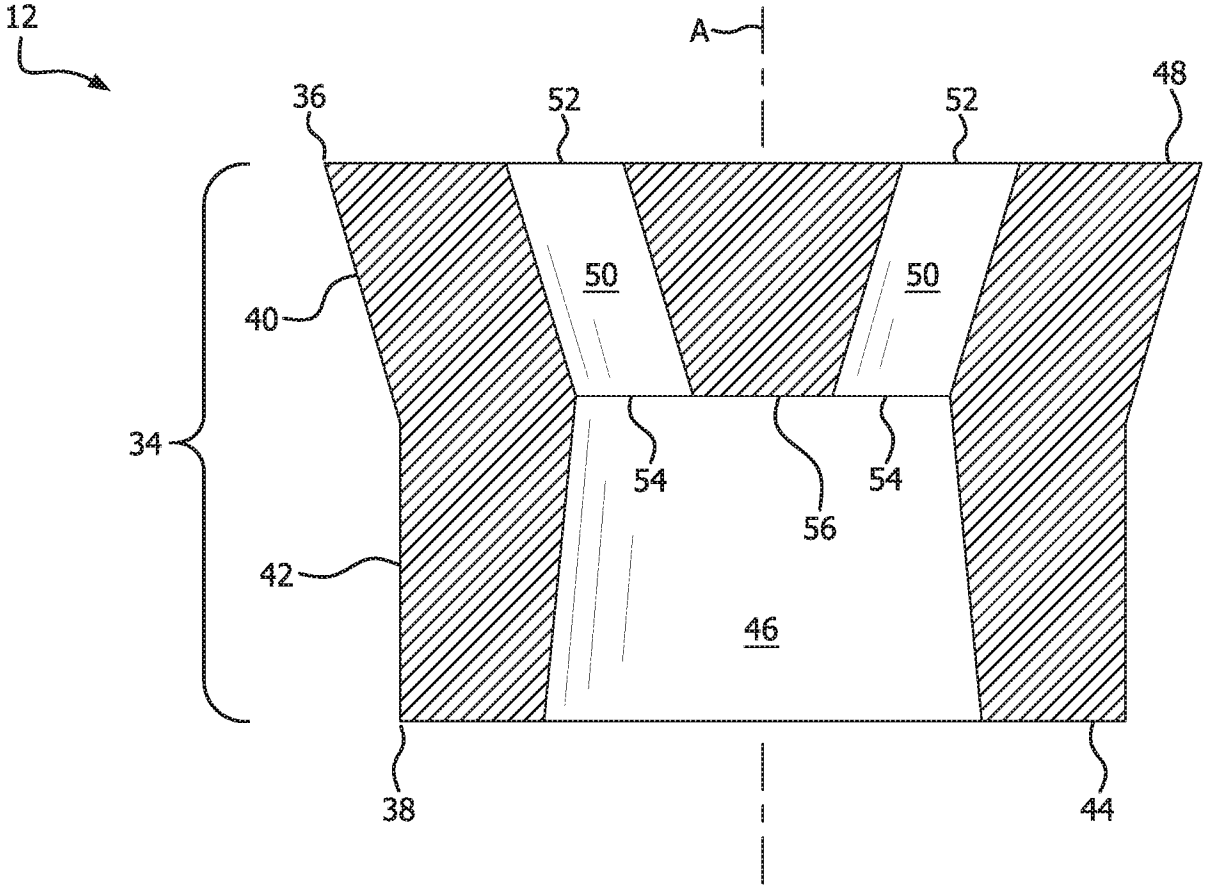
FIG. 6 is a cross sectional view of the retaining ring of FIG. 4.

Referring to FIGS. 4-6, a retention ring 12 is illustrated. Depending upon the pressure to which the retention ring 12 will be subjected, the retention ring 12 may be made from materials that are typically used for firearm cartridge components such as copper or brass, or from a steel such as stainless steel. The retention ring 12 includes a sidewall 34 that is wider at its top end 36 than at the bottom end 38. The retention ring 12 includes a side surface having a pressure-resisting configuration. The illustrated example of the sidewall 34 includes an upper portion 40 having a frustoconical configuration, and a lower portion 42 having a cylindrical configuration. Other configurations, for example, a sidewall that is frustoconical along its entire length, or a sidewall having a stepped surface between the upper and 36 and lower and 38, may be used without departing from the invention. The bottom surface 44 of the retention ring 12 defines a recess 46, which in the illustrated example has approximately the same, or slightly larger diameter as the recess 22 of the disk 10. In the illustrated example, the recess 46 extends upwards a distance approximately equal to that of the lower portion 42 of the sidewall 34.

The upper surface 48 of the retention ring 12 includes a plurality of smaller passageways 50, each of which has a top end 52 defined within the surface 48, and a bottom and 54 defined within the upper surface 56 of the recess 46. In the illustrated example, six passageways 50 are illustrated, although a greater or lesser number of passageways 50 can be used without departing from the scope of the invention. The passageways in the illustrated example are distributed substantially uniformly around the axis A. As used herein, substantially uniformly is defined as with sufficient uniformity so that reaction products from the ignitable material not enter one portion of the rear of the casing at a significantly greater rate than another portion of the rear of the casing. In the illustrated example, the passageways 50 are angled from parallel to the central axis A of the retention ring 12.

Figure 7:
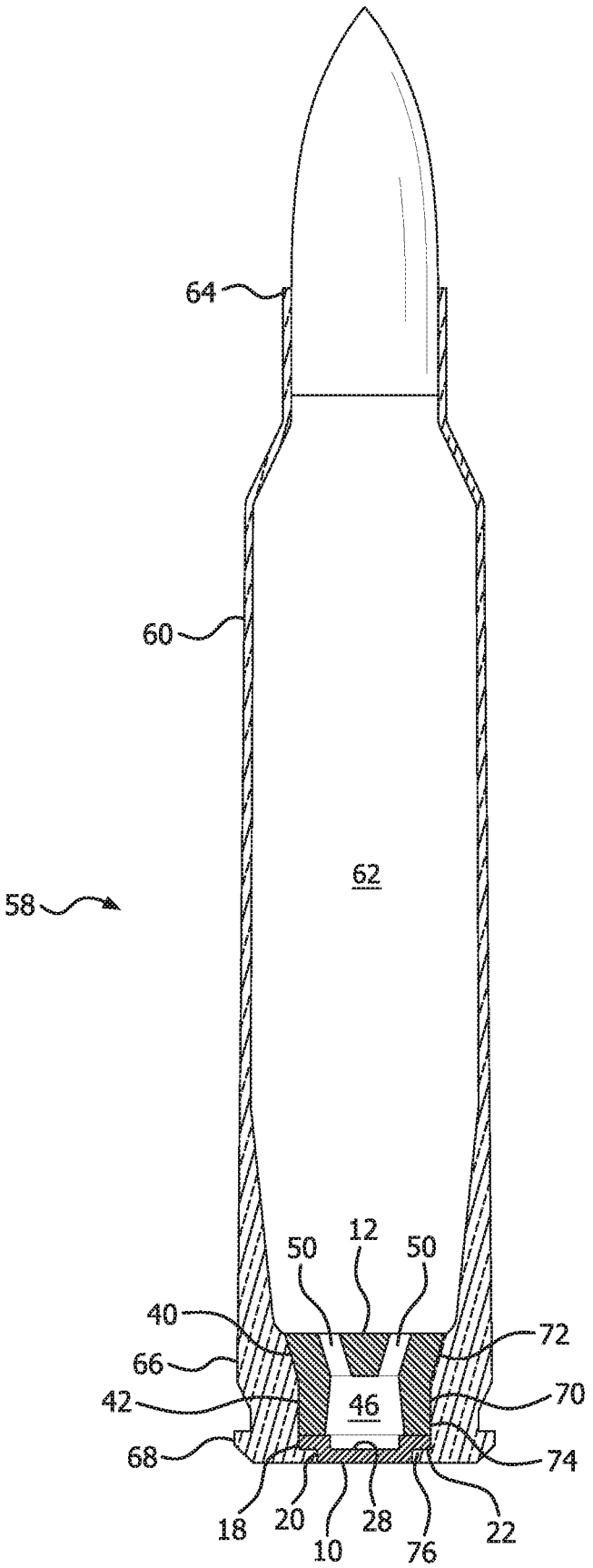
FIG. 7 is a cross sectional view of a cartridge casing having a primer disk of FIG. 1 and a retaining ring of Fig. installed therein.

Referring to FIG. 7, a cartridge casing 58 utilizing the primer assembly is illustrated. The casing 58 may be made from any material having sufficient strength to contain the pressure generated therein, as well as sufficient malleability to form a seal against the chamber of a firearm when the firearm is discharged. Examples include brass, aluminum, steel, or stainless steel. The casing 58 includes a sidewall 60 defining a space 62 therein for containing a propellant, a front end 64 for retaining a bullet in a conventional, well-known manner, and a backend 66 having a rim 68 and a primer pocket 70. The primer pocket 70 differs from the primer pocket of a conventional cartridge, and is designed to accommodate the primer assembly described herein. The primer pocket 70 includes a side surface that has a configuration that substantially corresponds to the pressure-resisting configurations of the disk and retaining ring. As used herein, the primer pocket substantially corresponds to these pressure-reducing surfaces if the pressure generated within the casing from burning of the propellant contained therein is safely contained within the casing, and the primer is safely retained in the primer pocket. The illustrated example of a primer pocket 70 includes a forward wall portion 72 corresponding to the frustoconical wall portion 40 of the retaining ring 12. A cylindrical primer pocket wall portion 74 corresponds to the lower portion 42 of the wall 34 of the retaining ring 12, as well as the outer edge 18 of the disk 10. An inwardly extending portion 76 is structured to abut the wall 20 and surface 22 of the disk 10. Thus, the wall portion 72 as well as the inwardly extending portion 76 resist passage of the disk 10 and retaining ring 12 out the back of the cartridge case 58 as a result of pressure buildup within the interior 62 of the casing 58. The disk 10 retaining ring 12 may be installed within the primer pocket 70 through the front end 64 of the casing 58, or by utilizing a casing 58 having a two-part wall 60, which is then assembled together around the disk 10 and retaining ring 12.

The primer assembly resists backward pressure from within the interior 62 in another way. The channels 50 between the recess 46 and the interior 62 of the casing 58 are angled. These channels 50 permit reaction products to travel from the recess 28 of the disk 10, through the recess 46 and channels 50 of the retaining ring 12, and into the interior 62 of the casing 58, thus igniting the propellant within the interior 62. As pressure develops within the interior 62, a portion of the pressure is borne by the surface 48 of the retaining ring 12, thus protecting the disk 10 from the effects of some of the pressure. Additionally, although pressure from the ignition of the propellant will travel through the passageways 50, the effects of this pressure on the disk 10 are dissipated by the angle of these passageways.

The thermite or other incendiary material can be deposited within the recess 28 of the disk 10 by a cluster tool machine. The process can begin with a cassette that contains a stack of substrates (which in the illustrated example are brass). The cassette is connected to two central chambers via a load lock. These central chambers are then connected to a number of planetary deposition chambers that are arranged in an arc or circle around the central chambers. A robot moves individual substrates to individual chambers for a specific deposition process. With a large number of chambers, for example, 8 to 10 chambers, multiple substrates can be processed simultaneously by the system. A microcontroller keeps track of each process being performed within the machine. In-situ measurement tools allow for precise control of deposition thicknesses.

The present invention therefore provides a primer for use with ignitable materials that do not have the toxicity or other safety issues of conventional primers. The primers are easily manufactured by methods that lend themselves to automation. The primer provides at least the reliability of conventional primers while also providing the opportunity to take advantage of the stability of thermite. The primer is useful not only for firearm cartridges, but also for other projectiles such as artillery, grenades, and other explosives and munitions. The primer assembly can withstand pressure in excess of the pressure that a conventional primer within a conventional primer pocket could withstand.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A firearm cartridge, comprising:

a casing having a sidewall, a front end, and a back end, the back end defining a primer pocket therein, the primer pocket having a side surface;

a primer, comprising:

a disk having a first surface, a second surface, and an edge defined between the first surface and second surface, the edge having a pressure-resisting configuration, the second surface of the disk having an ignitable material thereon;

a retention piece having an open end, a closed end, and a side wall extending therebetween, the open end being dimensioned and configured to substantially match the second face of the disk, the closed end having a larger cross sectional area than the open end, a portion of the side wall having a pressure-resisting configuration, the retention piece defining a recess within the open end, the retention piece further defining a central axis extending between the open end and the closed end, the retention piece defining a plurality of channels extending from the recess to the closed end, the channels being angled from parallel to the central axis; and the side surface of the primer pocket having a shape that substantially matches the pressure-resisting configuration of the disk and the pressure-resisting configuration of the retention piece;

whereby movement of the retention ring and disk caused by pressure inside the casing is resisted by interaction of the side surface of the primer pocket with the pressure-resisting configurations of the disk and retention piece.

2. The cartridge according to claim 1, wherein the second surface of the disk defines a recess therein, the ignitable material being located within the recess.

3. The cartridge according to claim 1, wherein the plurality of channels are distributed substantially uniformly around the retention piece.

* * * * *